US006786568B2

(12) United States Patent
Greive

(10) Patent No.: US 6,786,568 B2
(45) Date of Patent: Sep. 7, 2004

(54) METHOD AND DEVICE FOR PRINTING WITH ERROR OR FAULT CORRECTION

(75) Inventor: Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/389,581

(22) Filed: Mar. 14, 2003

(65) Prior Publication Data

US 2003/0174187 A1 Sep. 18, 2003

(30) Foreign Application Priority Data

Mar. 18, 2002 (DE) ..... 102 11 869

(51) Int. Cl.[7] ..... B41J 2/145; B41J 2/15; B41J 29/393

(52) U.S. Cl. ..... 347/40; 347/19

(58) Field of Search ..... 347/19, 37, 40, 347/12, 9

(56) References Cited

U.S. PATENT DOCUMENTS 4,907,013 A * 3/1990 Hubbard et al. ..... 347/19
4,996,487 A 2/1991 McSparran et al.
5,581,284 A 12/1996 Hermanson
5,587,730 A * 12/1996 Karz ..... 347/43
6,089,695 A * 7/2000 Takagi et al. ..... 347/40
6,227,644 B1 * 5/2001 Perner ..... 347/19
6,270,187 B1 8/2001 Murcia et al.

FOREIGN PATENT DOCUMENTS

EP 0 394 699 A1 10/1990
EP 0 983 855 A2 3/2000

* cited by examiner

*Primary Examiner*—Thinh Nguyen
(74) *Attorney, Agent, or Firm*—Laurence A. Greenberg; Werner H. Stemer; Ralph E. Locher

(57) ABSTRACT

A printing device for an ink-jet printing system includes at least one row of nozzles for overprinting a first process color, and a row of nozzles for overprinting a correction color. The correction color is different from the process color. A method of correcting failure of a nozzle in a print head of an ink-jet nozzle system is also provided.

18 Claims, 2 Drawing Sheets

METHOD AND DEVICE FOR PRINTING WITH ERROR OR FAULT CORRECTION

BACKGROUND OF THE INVENTION

Field of the Invention

The invention relates to a method and a device for printing with error or fault correction. More particularly, it relates to a print head for an ink-jet printing system having an error or fault correction device, and to a method of correcting errors or faults when printing with an ink-jet printing system.

In ink-jet printing systems, tiny droplets of ink are produced by one or more print heads and are applied to a printing material. In order to produce the droplets of ink, the print head is formed with a multiplicity of nozzle openings, each of which is connected to a respective pump mechanism. Pump chambers of the pump mechanism are filled with printing ink, and a device is provided by which positive or excess pressure can be produced briefly in the pump chamber. Due to the positive pressure, a small quantity, respectively, of printing ink is displaced and escapes via the nozzle opening. By a linear configuration of a multiplicity of nozzles for the same color, it is possible to print a large region of a page and an entire page, respectively, with a printing ink. If different inks, for example cyan, magenta, yellow and black, are then disposed after one another, it is possible to produce over an entire page a colored print resulting from the overprinting of a color separation for each printing ink. In practice, however, it has repeatedly been shown that, during the operation of the print heads, individual nozzles can fail and, thereby, a respective colored point or location is missing on the printing material. These missing print points can be detected by the eye and, to some extent, considerably disrupt the printed image.

In order to monitor the nozzle for the serviceability thereof, and to correct nozzles that have failed, it has been proposed, for example in U.S. Pat. No. 6,270,187, to monitor the serviceability of the individual nozzles continuously. As long as no fault results from this monitoring, the printing material would be printed in accordance with the stipulations. However, if it is detected that one of the nozzles has failed, it is proposed that all the nozzles in the row of colors which lie between the nonfunctioning nozzle and the end of the rows of nozzles be switched off. The task of the nozzles which have been switched off is then taken over by the other nozzles which are still functioning. In the most undesirable case, however, when a nozzle lying in the center of the row of nozzles should fail, only half of the row of nozzles can still be used, and therefore the printing speed is reduced considerably. As an alternative thereto, it is proposed that the printed point of the failed nozzle be set by an adjacent nozzle element, or that a substitute row of nozzles be provided, which is always then applied when a nozzle element fails.

In U.S. Pat. No. 5,581,284, it is proposed that, upon the failure of a nozzle, the colored point of the nonfunctioning nozzle be replaced by a colored point of a different color. Although this method can avoid excessively high visibility of the failure of a single nozzle as a result of a colored point not being set on the printing material, the disadvantage is that this method necessitates another, highly differing color (for example magenta) being set instead of the correct color (for example cyan). This type of correction is also visible to the human eye, in particular when a contribution to a colored line or colored area is to be printed with the failed nozzle.

SUMMARY OF THE INVENTION

It is accordingly an object of the invention to provide a method and a device for printing with error or fault correction, which overcome the hereinafore-mentioned disadvantages of the heretofore-known methods and devices of this general type and which provide a print head having a correction mechanism, and a method of correcting a print in the event of failure of a nozzle, wherein the correction is barely visible to the eye and the printing speed is simultaneously maintained.

With the foregoing and other objects in view, there is provided, in accordance with the invention, a printing device for an ink-jet printing system, comprising at least one row of nozzles for overprinting a first process color, and a row of nozzles for overprinting a correction color. The correction color is different from the process color.

In accordance with another feature of the invention, in addition to the one row of nozzles for overprinting the first process color, further rows of nozzles for overprinting further process colors are provided. The process colors overprintable by the first and the further rows of nozzles are cyan, magenta, yellow and black.

In accordance with a further feature of the invention, the printing device further includes a device for monitoring serviceability of the nozzles for overprinting the colors.

In accordance with an added feature of the invention, the device for monitoring serviceability is a device for monitoring voltage variation when controlling the nozzles for overprinting the colors.

In accordance with an additional feature of the invention, the printing device further includes an inspection system disposed between the rows of nozzles for overprinting the process colors, on the one hand, and the row of nozzles for overprinting the correction color, on the other hand, for monitoring the printed image applied by the process colors.

In accordance with yet another feature of the invention, the printing device further includes a device for controlling each individual nozzle of the row of correction nozzles when a malfunction of the nozzles for overprinting the process colors is detected.

In accordance with yet a further feature of the invention, the printing device further includes an inspection system disposed between the rows of nozzles for overprinting the process colors, on the one hand, and the row of nozzles for overprinting the correction color, on the other hand, for monitoring the printed image applied by the process colors. The device for controlling the individual correction nozzles is automatically activatable upon detection by the inspection device of a malfunction of the process nozzles.

In accordance with yet an added feature of the invention, the device for controlling the individual correction nozzles is automatically activatable upon detection of a malfunction of the process nozzles.

In accordance with yet an additional feature of the invention, the nozzle-controlling device serves for manually activating the individual nozzles of the row of correction nozzles.

In accordance with still another feature of the invention, the correction nozzles are connected to a color reservoir having a correction color formed of a weighted sum of the process colors.

In accordance with still a further feature of the invention, the correction color is a gray tone.

With the objects of the invention in view, there is also provided a method of correcting failure of a nozzle for overprinting a process color in a print head of an ink-jet nozzle system having a plurality of rows of nozzles, to each of which a respective process color is assigned. The method comprises detecting a failure of a nozzle for overprinting one of the process colors, and depositing a correction color different from the color of each of the process colors at a fault location on the printing material, which is caused by the failure of the nozzle.

In accordance with another mode, the method of the invention further includes monitoring each individual nozzle for overprinting the process colors for detecting the failure of the nozzle for one of the process colors.

In accordance with a further mode, the method of the invention further includes detecting the nozzle failure by an optical inspection system for monitoring the printed image applied to the printing material.

In accordance with an added mode, the method of the invention further includes activating a nozzle from a row of nozzles of a correction head for applying the correction color.

In accordance with an additional mode, the method of the invention further includes forming the applied correction color of a weighted mixture of the process colors being used.

In accordance with a concomitant mode, the method of the invention further includes forming the applied correction color as a gray tone.

According to the invention, in order to correct the failure of a nozzle in a print head, the point or location at which a nozzle has failed is thus occupied by a correction color. As a result of the use of a row of nozzles for overprinting a correction color, a row of nozzles is thus available for the entire width of the print head, and by the aid of the row of nozzles, each individual nozzle of the print head can be corrected. Since the correction color is different from each of the process colors which are used, the correction color can be used for any of the process colors being used. The corrected printing image will certainly not correspond exactly to the originally intended printed image, but it is possible to correct the printed image in such a way that the failure of the nozzle cannot be detected or can be detected only with difficulty.

The process colors cyan, magenta, yellow and black are normally used in one or more print heads. The correction color that is selected is therefore advantageously a gray, which results from a suitable percentage mixture ratio of the indicated process colors. In order to detect whether a correction nozzle must be activated, in principle all those methods are available by the aid of which it is possible to detect whether one of the nozzles of the process colors has failed. In particular, each individual nozzle of the process colors can be monitored for serviceability thereof during the overprinting. When it is detected that a nozzle has failed, the corresponding correction nozzle of the correction head can be activated.

As an alternative thereto, it is also possible to monitor the printed image applied with the aid of the process colors. This is normally done with the aid of a scanner, which is disposed to follow the process color nozzles. The scanner registers the printed image applied by the process print heads and compares it with a desired or nominal printed image. If differences result from this desired-actual comparison and permit a conclusion to be drawn regarding the failure of an individual nozzle in one of the process colors, then the corresponding correction nozzle is activated and the correction color is introduced into the fault location. With the use of the correction head according to the invention, it is therefore possible in the ink-jet method to correct the failure of an individual nozzle regardless of the type of process color.

Other features which are considered as characteristic for the invention are set forth in the appended claims.

Although the invention is illustrated and described herein as embodied in a method and a device for printing with fault or error correction, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
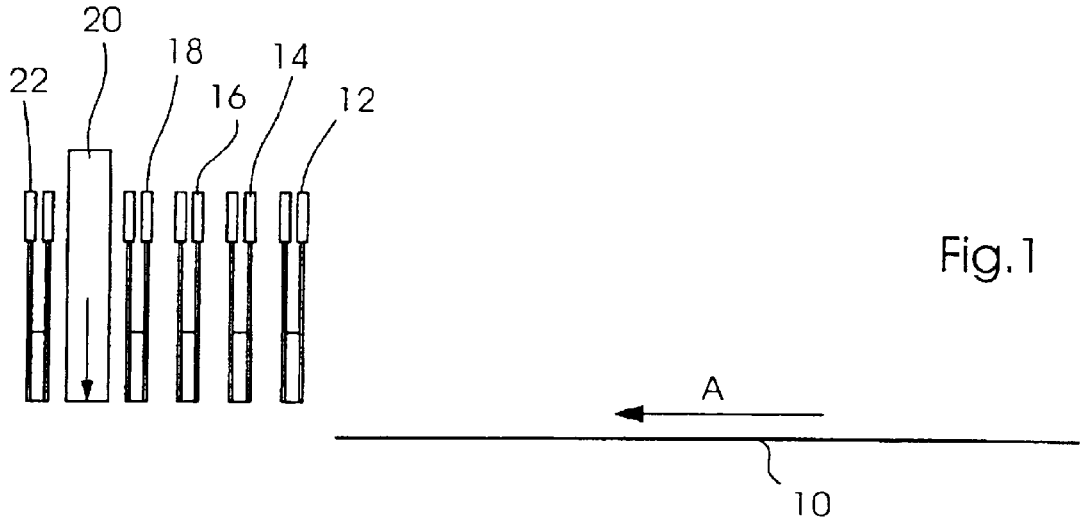
FIG. 1 is a diagrammatic, side-elevational view of a print head according to the invention.

Referring now to the figures of the drawings in detail and first, particularly, to FIG. 1 thereof, there is seen a first embodiment of a correction head according to the invention. In this case, a paper sheet 10 is moved into a paper conveying device represented by the arrow A. The printed image to be applied to the paper sheet 10 is applied with the aid of different process colors. In this regard, different respective print heads 12, 14, 16, and 18 containing the various process colors are normally used. The print head 12 contains the process color cyan, the print head 14 the process color magenta, the print head 16 the process color yellow and the print head 18 the process color black. In this regard, one must take into account that, for one, other process colors can also be used and, for another, more or less of the specified process color print heads 12, 14, 16 and 18 can be used, because this depends only upon the desired printed image. Provided downstream of the last process color print head 18 is a registration device 20 for registering the printed image which has been applied to the paper sheet 10. In this regard, an optical inspection device, such as a scanner, in particular, can be used. The registration device 20 registers the printed image applied to the paper sheet 10. By comparing this printed image with a stored nominal or desired printed image which, for example, can be provided in a non-illustrated computing unit, a determination is made as to whether one and more, respectively, of the nozzles of the process color heads 12, 14, 16 or 18, have failed. If this is the case, a correction head 22 is controllingly driven so that the failure of this nozzle and these nozzles, respectively, is compensated for by the activation of corresponding nozzles of the correction head 22. In this regard, a corrective printing ink is applied to the faulty or error location in the printed image.

Figure 2:
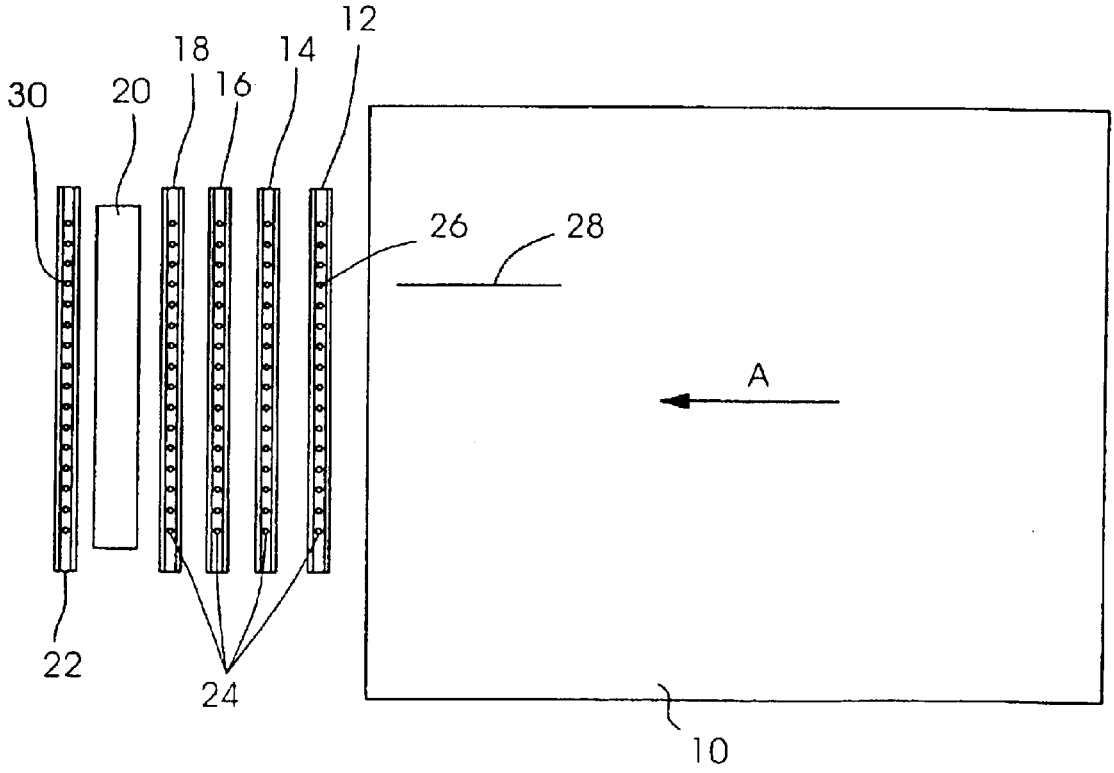
FIG. 2 is a diagrammatic, plan view of FIG. 1.

This procedure may be clarified once more by reference to the plan view of FIG. 2. The paper sheet 10 moves in the conveying direction represented by the arrow A and is led appropriately past the process color print heads 12, 14, 16 and 18. Each of these process color print heads is equipped with nozzles 24. The nozzles are located adjacent one another within each print head in the illustrated embodiment, i.e., they are disposed in respective rows. It is accordingly possible to apply the applicable process colors, respectively, line-by-line to the paper sheet. However, in order to fit the nozzles within the print head, other configurations are also considered if, as a result, for example the density of the colored points which is to be placed on the paper sheet 10 can be increased. Thus, in each or one process color print head of a color, the nozzles can also be disposed in two rows, in particular offset in relation to one another in the rows. With the aid of the registration device 20, following the application of all the process colors to the paper sheet, the printed image applied to the paper sheet is monitored and then examined to see whether a nozzle 24 in one of the process color print heads 12, 14, 16, 18 has failed. If this is established with the aid of an electronic evaluation of the results obtained via the registration device 20, a correction head 22 disposed downstream of the process color print heads 12, 14, 16, 18 in the conveying direction of the paper sheet, which is represented by the arrow A, is activated, so that this fault can be compensated for. In this regard, a correction color is applied to the paper sheet.

For example, as a result of a failure of the nozzle 26 in the process color print head 12, the line 28 will not be printed on the paper sheet. This is detected via the registration device 20. The correction nozzle 30 corresponding to the nozzle 26 and belonging to the correction head 22 is then activated, and the line 28, which is erroneously not occupied by process printing ink, is occupied by the correction color 30, if appropriate in accordance with the pattern to be applied.

Figure 3:
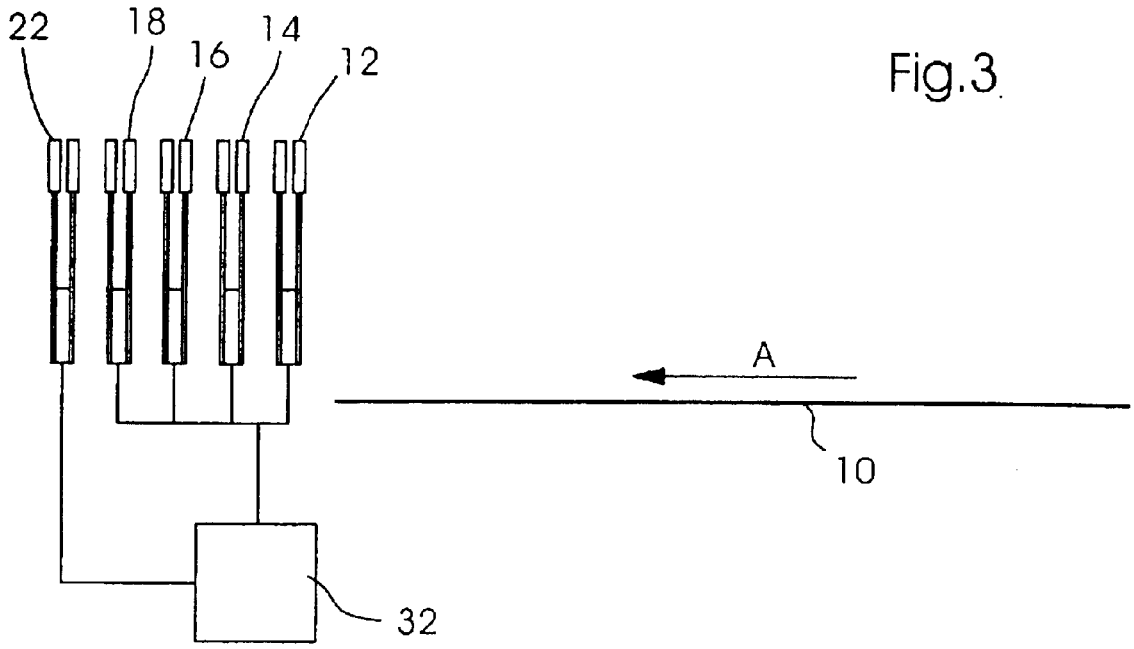
FIG. 3 is a view similar to that of FIG. 1 of a schematically and diagrammatically illustrated alternative correction head configuration.

In FIG. 3 a further embodiment of the invention is shown, wherein the device according to the invention basically manages without the registration device 20. Again, the paper sheet 10 is moved in the conveying direction of the arrow A relative to process color print heads 12, 14, 16 and 18 in order to provide the paper sheet with printing ink. Each of the process color print heads 12, 14, 16 and 18 is connected to a monitoring device 32, which monitors the correct function of all the nozzles 24 of the process color print heads 12, 14, 16 and 18. Upon a determination that one of the nozzles 24 of the process color print heads has failed, the correction nozzle head 22 is activated either via the monitoring device 32 or via a non-illustrated monitoring device to be provided separately and, as described hereinbefore, a correction color is applied in order to compensate for the failed or omitted process color.

Before the activation of the correction head 22, a check can moreover be made to determine whether the failed nozzle of the process color print head is actually to be corrected with a correction printing ink. In this case, it is possible in particular to take into account whether the failed process color together with the background or the color of the paper sheet 10 makes any correction necessary. For example, it is possible to dispense with a correction by the correction head 22 when the failed process color is yellow and the surface of the paper sheet is white. In addition, it is possible, before using the correction print head, to set different threshold values, the correction head being activated only when these threshold values are exceeded. This can be advantageous in particular when only individual points are overprinted in only specific regions and cannot readily be perceived by the eye even without any correction by the correction head 22. If desired, a further correction head can also be provided, which is fitted with a correction color that is different from the correction color of the first correction head 22.

If the simplest possible structure is required, then it is also possible to dispense with the automatic activation of the correction nozzle and/or the automatic detection of a failed process nozzle. The printed image then has to be checked manually for the failure of a process nozzle by the operating personnel, and the correction nozzle correspondingly activated manually. For this purpose, an activation facility, for example a switch or a possible software intervention, then has to be provided.

I claim:

1. A printing device for an ink-jet printing system, comprising:

at least one row of nozzles for overprinting a first process color; and a row of nozzles for overprinting a correction color being different from said row of nozzles for overprinting the first process color and the correction color being different from the first process color; and at least one nozzle of said row of nozzles for overprinting the correction color applying the correction color to an error location in a printed image caused by a failure of a corresponding nozzle of said row of nozzles for overprinting the first process color.

2. The printing device according to claim 1, which further comprises further rows of nozzles for overprinting further process colors, in addition to said at least one row of nozzles for overprinting said first process color, said process colors to be overprinted by said first and said further rows of nozzles being cyan, magenta, yellow and black.

3. The printing device according to claim 2, further comprising an inspection system disposed between said rows of nozzles for overprinting said process colors and said row of nozzles for overprinting said correction color, for monitoring the printed image applied by said process colors.

4. The printing device according to claim 2, further comprising a device for controlling each individual nozzle of said row of correction nozzles upon detection of a malfunction of said nozzles for overprinting said process colors.

5. The printing device according to claim 4, further comprising an inspection system disposed between said rows of nozzles for overprinting said process colors and said row of nozzles for overprinting said correction color, for monitoring the printed image applied by said process colors, said device for controlling said individual correction nozzles being automatically activatable upon detection by said inspection device of a malfunction of said process nozzles.

6. The printing device according to claim 4, wherein said device for controlling said individual correction nozzles is automatically activatable upon detection of a malfunction of said process nozzles.

7. The printing device according to claim 4, wherein said nozzle-controlling device serves for manually activating said individual nozzles of said row of correction nozzles.

8. The printing device according to claim 1, further comprising a device for monitoring serviceability of said nozzles for overprinting said colors.

9. The printing device according to claim 8, wherein said device for monitoring serviceability is a device for monitoring voltage variation when controlling said nozzles for overprinting said colors.

10. The printing device according to claim 1, wherein said correction nozzles are connected to a color reservoir having a correction color formed of a weighted sum of said process colors.

11. The printing device according to claim 10, wherein said correction color is a gray tone.

12. A method of correcting failure of a nozzle for overprinting a process color in a print head of an ink-jet nozzle system having a plurality of rows of nozzles, each assigned a respective process color, the method which comprises:

detecting a failure of a nozzle for overprinting one of the process colors; and depositing a correction color different from the color of each of the process colors at a location of a fault on the printing material caused by the failure of the nozzle.

13. The method according to claim 12, which further comprises monitoring each individual nozzle for overprinting the process colors for detecting the failure of the nozzle for one of the process colors.

14. The method according to claim 12, which further comprises detecting the nozzle failure with an optical inspection system for monitoring the printed image applied to the printing material.

15. The method according to claim 12, which further comprises activating a nozzle from a row of nozzles of a correction head for applying the correction color.

16. The method according to claim 12, which further comprises forming the applied correction color of a weighted mixture of the process colors being used.

17. The method according to claim 12, which further comprises forming the applied correction color as a gray tone.

18. A method of correcting failure of a nozzle in a print head of an ink-jet nozzle system having a plurality of rows of nozzles, each assigned a respective process color, the method which comprises:

detecting a failure of a nozzle for one of the process colors; and depositing a correction color different from the color of each of the process colors at a location of a fault on the printing material caused by the failure of the nozzle.

* * * * *